US010689139B2

(12) United States Patent
Shindou

(10) Patent No.: US 10,689,139 B2
(45) Date of Patent: Jun. 23, 2020

(54) REINFORCING BAR BINDING MACHINE

(71) Applicant: MAX CO., LTD., Chuo-ku, Tokyo (JP)

(72) Inventor: Shigeki Shindou, Chuo-ku (JP)

(73) Assignee: MAX CO., LTD., Tokyo (JP)

( * ) Notice: Subject to any disclaimer, the term of this patent is extended or adjusted under 35 U.S.C. 154(b) by 1247 days.

(21) Appl. No.: 14/809,316

(22) Filed: Jul. 27, 2015

(65) Prior Publication Data

US 2016/0031576 A1 Feb. 4, 2016

(30) Foreign Application Priority Data

Jul. 31, 2014 (JP) ..... 2014-157195

(51) Int. Cl.

| | |
|---|---|
| ***B65B 13/04*** | (2006.01) |
| ***B65B 13/02*** | (2006.01) |
| ***B65B 13/28*** | (2006.01) |
| ***E04G 21/12*** | (2006.01) |

(52) U.S. Cl.

CPC ..... *B65B 13/04* (2013.01); *B65B 13/025* (2013.01); *B65B 13/285* (2013.01); *E04G 21/123* (2013.01)

(58) Field of Classification Search

CPC ..... B65B 13/04; B65B 13/025; B65B 13/285; E04G 21/123

See application file for complete search history.

(56) References Cited

U.S. PATENT DOCUMENTS 5,983,473 A 11/1999 Yuguchi et al.
8,127,803 B2 * 3/2012 Kusakari ..... E04G 21/122 140/123.6
2006/0283516 A1 12/2006 Nagaoka et al.
2009/0090428 A1 4/2009 Kasahara et al.
2009/0283168 A1 11/2009 Kusakari
2010/0147411 A1 6/2010 Kusakari et al.
(Continued)

FOREIGN PATENT DOCUMENTS

CN 1184521 A 6/1998
CN 102441625 A 5/2012
(Continued)

OTHER PUBLICATIONS

Notification of First Office Action dated Jul. 20, 2018 in corresponding Chinese Patent Application No. 201510463383.0 (with an English translation) (16 pages).
(Continued)

*Primary Examiner* — Teresa M Ekiert
(74) *Attorney, Agent, or Firm* — Rothwell, Figg, Ernst & Manbeck, P.C.

(57) ABSTRACT

A reinforcing bar bending machine mounts a wire reel, feeds a wire from the wire reel to a guide part, curls the wire at the guide part, cuts the wire to bind reinforcing bars. The guide part includes a guiding part, a cutting part, a curl guide, first, second and third guide members. The guiding part guides the wire from the wire reel. The cutting part cuts the wire. The curl guide guides the wire fed from the guiding part or the cutting part to curl the fed wire. The first and third guide members guide an outer side of the wire to be bent. The second guide member guides an inner side of the wire to be bent. The first, second and third guide members are arranged in order from the guiding part. Any one of the first, second and third guide members serves as the cutting part.

9 Claims, 6 Drawing Sheets

(56) References Cited

U.S. PATENT DOCUMENTS

| | | | |
|---|---|---|---|
| 2010/0313991 | A1 | 12/2010 | Nagaoka et al. |
| 2011/0155277 | A1 | 6/2011 | Coles et al. |
| 2014/0246114 | A1 | 9/2014 | Kusakari et al. |
| 2015/0176295 | A1 | 6/2015 | Kasahara et al. |
| 2015/0267423 | A1 | 9/2015 | Kusakari et al. |
| 2016/0222683 | A1 | 8/2016 | Kusakari et al. |
| 2017/0145704 | A1 | 5/2017 | Coles et al. |

FOREIGN PATENT DOCUMENTS

| | | | |
|---|---|---|---|
| CN | 102720366 | A | 10/2012 |
| DE | A1-2804300 | | 8/1979 |
| EP | 0 886 020 | A1 | 12/1998 |
| EP | A1-2123849 | | 11/2009 |
| EP | 2 196 600 | A2 | 6/2010 |
| JP | 2010-001070 | A | 1/2010 |
| JP | B2-5309947 | | 7/2013 |
| TW | A-200523443 | | 7/2005 |
| TW | A-200714519 | | 4/2007 |
| TW | A-201006997 | | 2/2010 |
| WO | WO-A2-2007-042785 | | 4/2007 |

OTHER PUBLICATIONS

A European Office Action dated Jan. 25, 2017 from corresponding European Application No. 15002269.7 (6 pages).
Extended European Search Report dated Mar. 22, 2018 in corresponding European patent application No. 18153572.5 (8 pages).
Further Examination Report dated Nov. 30, 2018 in corresponding New Zealand Patent Application No. 710451 (3 pages).

* cited by examiner

REINFORCING BAR BINDING MACHINE

CROSS-REFERENCE TO RELATED APPLICATION

This application is based on and claims priority under 35 USC119 from Japanese Patent Application No. 2014-157195 filed on Jul. 31, 2014.

TECHNICAL FIELD

The present invention relates to a reinforcing bar binding machine configured to feed a wire, which is fed from a wire reel, to a guide part provided at a tip portion of a binding machine main body, to curl the wire at the guide part, to feed the wire around reinforcing bars positioned at an inner side of the guide part so that the wire is wound around the reinforcing bars into a loop shape, and to twist the wire to thus bind the reinforcing bars.

BACKGROUND

A reinforcing bar binding machine is configured to feed a wire for binding reinforcing bars from a wire reel accommodated in a binding machine main body and to feed the same to a guide part provided at a tip portion of the binding machine main body by a wire feeding means. The wire is curled by a curling mechanism of the guide part and is fed around reinforcing bars positioned at an inner side of the guide part with being curled so that the wire is wound around the reinforcing bars into a loop shape. Then, the reinforcing bar binding machine is configured to cut the wire by a wire cutting mechanism and to twist one side of the loop-shaped wire by a pair of hooks of a wire twisting device, thereby binding the reinforcing bars. Like this, the guide part of the reinforcing bar binding machine is provided with the curling mechanism configured to curl and feed the wire.

The guide part of the reinforcing bar binding machine is provided with three components, i.e., a guiding part configured to guide feeding of the wire from the wire reel, a cutting part of the wire cutting mechanism for cutting the wire after a predetermined length of the wire is fed, and a curl guide configured to bend the wire fed from the wire cutting mechanism, which are sequentially arranged in order (for example, refer to Patent Document 1). The three components of the guide part have a function of a guide member for curling the wire, and configure the curling mechanism. [Patent Document 1] JP-A-2010-001070

SUMMARY

However, the curling mechanism provided for the guide part of the reinforcing bar binding machine has following problems. First, it is difficult to form a constant curl diameter of the wire that is to be wound around the reinforcing bars into a loop shape. The three components have complicated shapes and non-uniform component sizes, and attaching positions of the components are not uniform, so that the curl diameter is likely to be non-uniform. When a curl diameter of the wire fed from the guide part is too small, the pair of hooks of the wire twisting device may not grip the wire, and a start end portion of the wire completely wound in a loop shape may not enter a curl pickup guide of the guide part. When the curl diameter of the wire fed from the guide part is too large, the start end portion of the wire contacts the curl pickup guide (or a lower guide), so that the loop may not be configured. Therefore, the reinforcing bar binding machine of the related art has problems that it is very troublesome to manage the sizes of the three components and the cost increases.

Second, the three components for curling are always rubbed by the steel wire and are thus worn. In particular, the curl guide configured to curl the wire is severely worn, so that the lifespan thereof is shortened. Third, the wear increases a feeding resistance of the wire, so that the wire feeding is not smoothly performed. Fourth, the curling function is weakened due to the wear during the repeating use, so that the curl diameter of the wire increases. When the curl diameter of the wire becomes larger, the above-described problems occur, so that the components should be replaced for the wire guide. Fifth, the three components may be hardened against the wear. However, since the shapes of the components are complicated, the material (hardness) is limited, so that the time and labor are consumed.

It is therefore an object of the present invention to provide a reinforcing bar binding machine capable of curling a wire so that a curl diameter of the wire is substantially constant, reducing wear to improve lifespan of a component, smoothly feeding the wire and reducing a manufacturing cost by providing a guide part with at least three guide members configured to guide outer and inner surfaces of the wire and configuring a wire curling mechanism with the at least three guide members.

(1) According to one aspect of the present invention, a reinforcing bar bending machine is configured to detachably mount a wire reel thereto, to feed a wire from the mounted wire reel, to feed the wire to a guide part provided at a tip portion of a binding machine main body, to curl the wire at the guide part, to feed the wire around reinforcing bars positioned at an inner side of the guide part so that the wire is wound around the reinforcing bars, to cut the wire and to twist the wire to thus bind the reinforcing bars. The guide part includes a guiding part, a cutting part, a curl guide, a first guide member, a second guide member and a third guide member. The guiding part is configured to guide feeding of the wire from the wire reel. The cutting part is configured to cut the wire after a predetermined length of the wire is fed from the guiding part. The curl guide is configured to guide the wire fed from the guiding part or the cutting part so as to curl the fed wire. The first guide member is configured to guide an outer surface which is an outer side of the wire to be bent. The second guide member is configured to guide an inner surface which is an inner side of the wire to be bent. The third guide member is configured to guide an outer surface which is an outer side of the wire to be bent. The first guide member, the second guide member and the third guide member are arranged in order from the guiding part. Any one of the first guide member, the second guide member and the third guide member serves as the cutting part.

(2) In the reinforcing bar bending machine according to (1), the third guide member serves as the cutting part.

(3) In the reinforcing bar bending machine according to (1), the second guide member serves as the cutting part.

(4) In the reinforcing bar bending machine according to (1), the first guide member serves as the cutting part.

(5) According to another aspect of the present invention, a reinforcing bar bending machine is configured to detachably mount a wire reel thereto, to feed a wire from the mounted wire reel, to feed the wire to a guide part provided at a tip portion of a binding machine main body, to curl the wire at the guide part, to feed the wire around reinforcing bars positioned at an inner side of the guide part so that the wire is wound around the reinforcing bars, to cut the wire and to twist the wire to thus bind the reinforcing bars. The guide part includes a guiding part, a cutting part, a curl guide, a wire feeding passage, a first guide member, a second guide member and a third guide member. The guiding part is configured to guide feeding of the wire from the wire reel. The cutting part is configured to cut the wire after a predetermined length of the wire is fed from the guiding part. The curl guide is configured to guide the wire fed from the guiding part or the cutting part so as to curl the fed wire. The wire feeding passage path includes the guiding part, the cutting part and the curl guide. The first guide member is configured to guide an outer surface which is an outer side of the wire to be bent. The second guide member is configured to guide an inner surface which is an inner side of the wire to be bent. The third guide member is configured to guide an outer surface which is an outer side of the wire to be bent. The first guide member, the second guide member and the third guide member are arranged in order from the guiding part on the wire feeding passage path. The cutting part is on the wire feeding passage path other than a region of between the second guide member and the third guide member.

(6) In the reinforcing bar bending machine according to (5), the cutting part is provided at a downstream portion of the third guide member on the wire feeding passage path.

(7) In the reinforcing bar bending machine according to (5), the cutting part is provided between the first guide member and the second guide member on the wire feeding passage path.

(8) In the reinforcing bar bending machine according to (5), the cutting part is provided between the guiding part and the first guide member on the wire feeding passage path.

(9) The reinforcing bar bending machine according to any one of (1) to (8), at least one of the first guide member, the second guide member and the third guide member is a guide pin.

(10) The reinforcing bar bending machine according to (1) or (5), the third guide member is arranged at the curl guide or in a vicinity of the curl guide.

According to the reinforcing bar bending machine of the present invention, the guide part is provided with at least the first guide member configured to guide an outer surface of the wire becoming a bent outer side thereof, the second guide member configured to guide an inner surface of the wire becoming a bent inner side thereof and the third guide member configured to guide an outer surface of the wire becoming a bent outer side thereof, and the wire curling mechanism is configured by at least the three guide members. According to the reinforcing bar bending machine of the present invention, since the curling mechanism of the guide part is configured by at least the three guide members, it is possible to curl the wire to be wound around the reinforcing bars into a loop shape so that a curl diameter of the wire is substantially constant. For this reason, the binding defect is reduced, so that it is possible to keep the stable wire binding effect. Also, since the wire is guided by at least the three guide members, the contact of the wire with the component such as the guiding part, the curl guide and the like can be reduced. Thereby, it is possible to reduce the wear and to thus improve the lifespan of the component. Also, since the wire is guided by at least the three guide members, it is possible to smoothly feed the wire.

BRIEF DESCRIPTION OF THE DRAWINGS

FIGS. 7A and 7B are side views illustrating a third illustrative embodiment of the curling mechanism, in which FIG. 7A illustrates that a sliding-type slide cutter is used and FIG. 7B illustrates that a swinging-type slide cutter is used.

DETAILED DESCRIPTION

Figure 1:
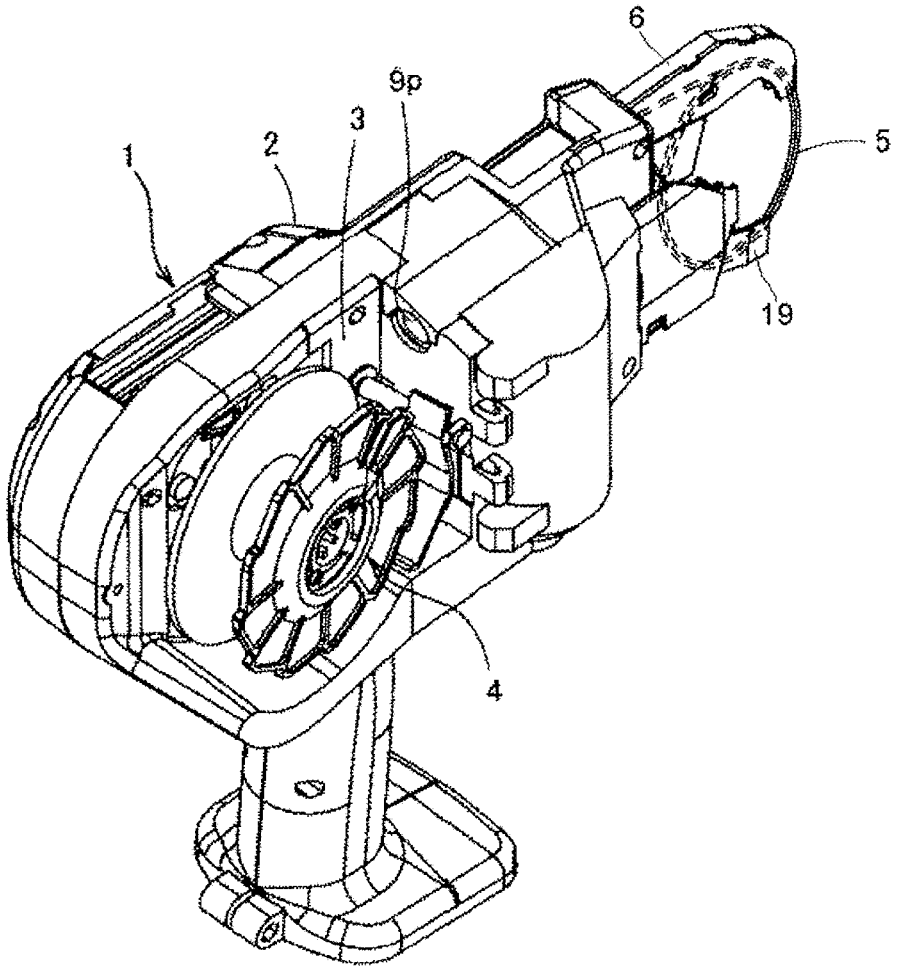
FIG. 1 is a perspective view illustrating an illustrative embodiment of a reinforcing bar binding machine of the present invention, in which a side cover is taken off.
Figure 2:
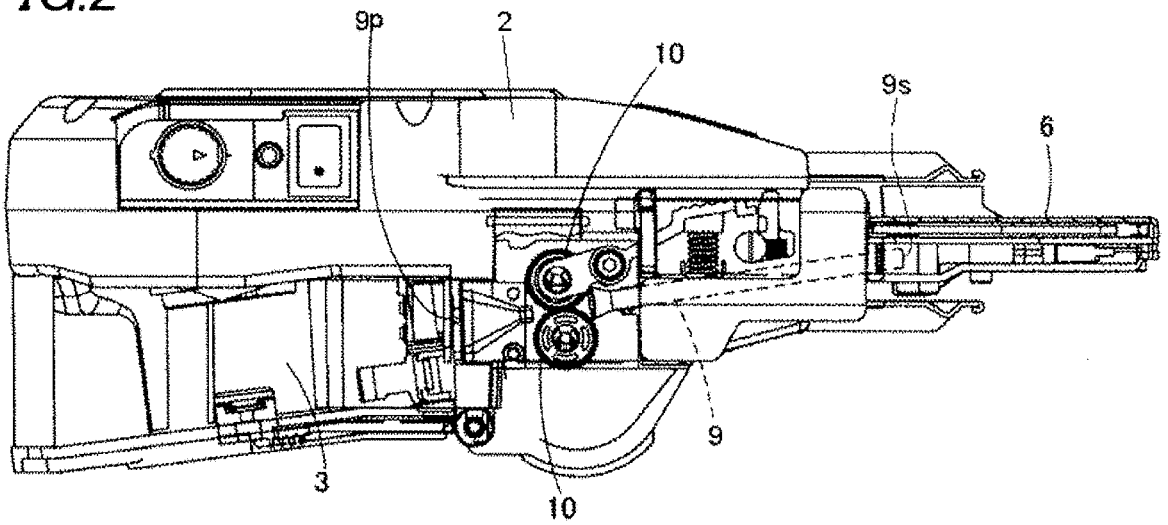
FIG. 2 is a plan view illustrating main part of an upper surface of the reinforcing bar binding machine shown in FIG. 1.
Figure 3:
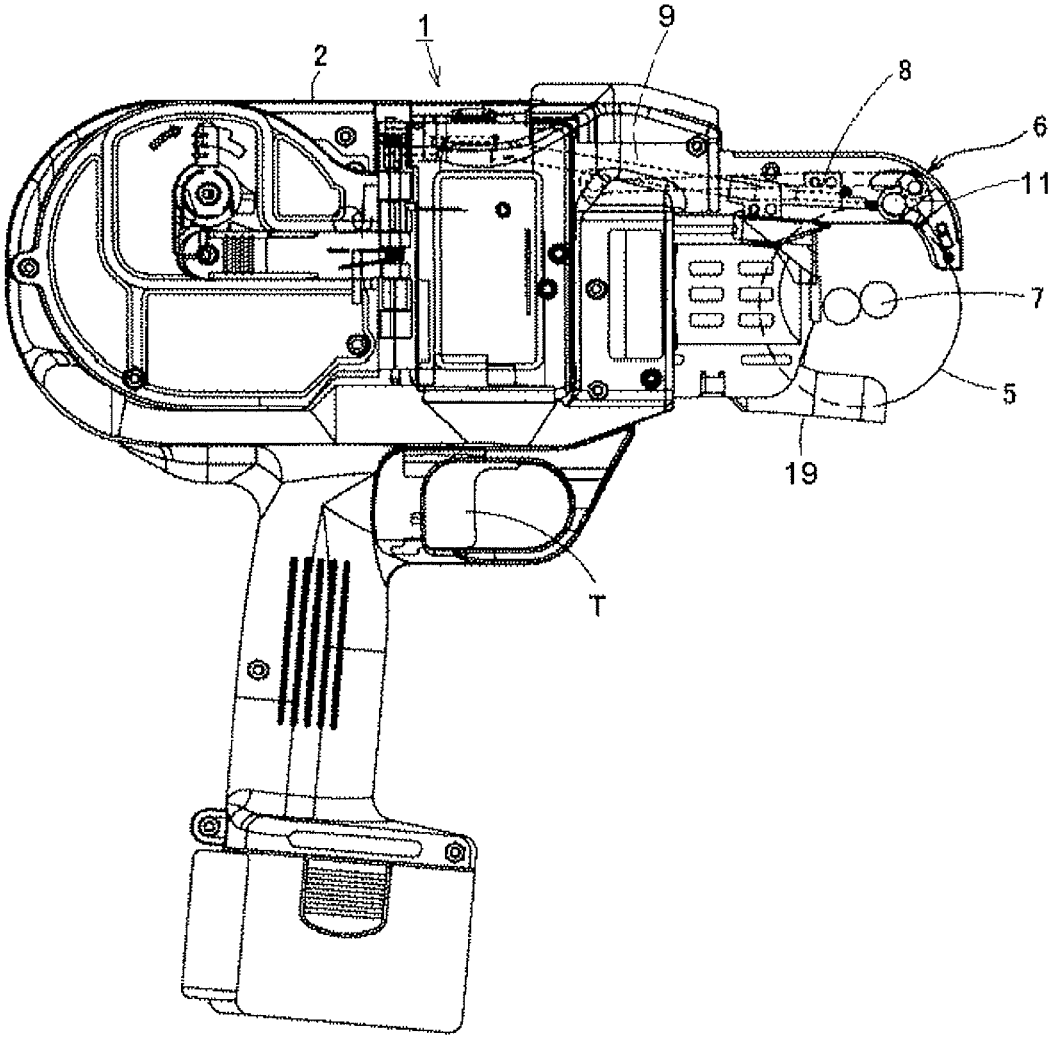
FIG. 3 is a side view of the reinforcing bar binding machine shown in FIG. 1.

As shown in FIGS. 1 to 3, a reinforcing bar binding machine 1 is configured to mount a wire reel 4, on which a wire 5 for binding reinforcing bars is wound, in an accommodation chamber 3 provided for a binding machine main body 2, to pull out the wire 5 while rotating the wire reel 4, to feed the wire to a guide part 6 provided at a tip portion of the binding machine main body 2, to curl the wire 5 at the guide part 6, to feed the wire around reinforcing bars 7 positioned at an inner side of the guide part 6 so that the wire is wound around the reinforcing bars, to cut an end of the wire 5 by a wire cutting mechanism, and to twist the wound part to thus bind the reinforcing bars 7 by a wire twisting device.

The binding machine main body 2 is provided with a main body-side guiding part (guide member) 9 for enabling the wire 5 fed from the wire reel 4 to pass. One end 9*p* (refer to FIG. 1) of the main body-side guiding part (guide member) 9 opens into the accommodation chamber 3, and the other end 9*s* is positioned in front of the guide part 6. A pair of wire feeding gears 10 functioning as a feeding means of the wire 5 is arranged on the way of the main body-side guiding part (guide member) 9, as shown in FIG. 2. The wire 5 is fitted in feeding recesses formed at the pair of wire feeding gears 10, and the wire 5 is fed forwards by an electric motor (not shown).

When a switch becomes ON by a trigger T, the electric motor (not shown) is rotated to rotate the wire feeding gears 10. As the wire feeding gears 10 are rotated, the wire 5 wound on the wire reel 4 accommodated in the accommodation chamber 3 is fed towards the front of the binding machine main body 2 through the main body-side guiding part (guide member) 9.

The gently bent guide part 6 is attached to a tip portion of the binding machine main body 2. As shown in FIG. 5, the guide part 6 is provided with a guide-side guiding part (guide member) 8. The other end 9*s* of the main body-side guiding part (guide member) 9 is connected to a rear end 8*c* of the guide-side guiding part (guide member) 8. The guide part 6 is configured to feed the wire 5, which is fed from the main body-side guiding part (guide member) 9 of the binding machine main body 2, from a tip portion 8*d* via the guide-side guiding part (guide member) 8, to curl the wire 5 and then to feed the curled wire. The guide part 6 is formed by a guide frame 13. The guide frame 13 has a pair of frame plates 13*a*, 13*b* (refer to FIG. 4), and the one frame plate 13*a* is assembled to the other frame plate 13*b*. A tip portion of the guide part 6 is bent into an arc shape, at which the wire is curled and circulates around the reinforcing bars 7 between the tip portion and a lower guide 19.

As described above, the guide-side guiding part (guide member) 8 configured to guide the feeding of the wire 5 from the wire reel 4, a wire cutting mechanism 11 arranged on a feeding path of the wire so as to cut the wire 5 after the predetermined length of the wire 5 is fed, as shown in FIG. 5, and a curl guide 12 configured to bend the wire 5 are arranged on the guide frame 13 configuring the guide part 6.

A guide path 8*e* of the guiding part (guide member) 8, through which the wire 5 is inserted, has an inner diameter narrowed towards the tip portion 8*d*, so that the wire 5 is fed from a predetermined position. The guide part 6 is provided with the curling mechanism configured to curl the wire 5 and then feed the same. The wire 5 guided and fed by the guide-side guiding part (guide member) 8 is curled by the curling mechanism, is fed by a predetermined length, is wound around the reinforcing bars 7 and is then cut by the wire cutting mechanism 11.

When a feeding amount of the wire 5 reaches a predetermined amount, the wire cutting mechanism 11 cuts the wire 5. The wire cutting mechanism 11 is a rotary cutter having a circular shaft-shaped fixed blade 14 fixed to the guide frame 13, a moving blade 15 configured to be rotatable around the fixed blade 14, and a driving lever 16 configured to rotate the moving blade 15.

The circular shaft-shaped fixed blade 14 is formed with a wire through-hole 17, which is penetrated towards a feeding direction of the wire 5. One end of the wire through-hole 17 opens towards the tip portion 8*d* of the guide-side guiding part (guide member) 8, and the other end thereof opens towards the tip-side of the guide part 6. One end-side opening of the wire through-hole 17 is a wire entry opening 17*a*, and the other end-side opening of the wire through-hole 17 is a wire exit opening 17*b*. Also, the moving blade 15 is formed with a wire insertion through-hole 15*a*, which is penetrated towards the feeding direction of the wire 5. One end of the wire insertion through-hole 15*a* opens towards the wire exit opening 17*b* of the wire through-hole 17 of the fixed blade 14, and the other end thereof opens towards the tip-side of the guide part 6. One end-side opening of the wire insertion through-hole 15*a* of the moving blade 15 is a wire introduction opening 15*b*, and the other end-side opening of the wire insertion through-hole 15*a* is a wire discharge opening 15*c*.

The wire cutting mechanism 11 is configured to rotate the moving blade 15 in a counterclockwise direction by the driving lever 16, thereby enabling a surface of the moving blade 15 facing the wire introduction opening 15*b* to upwards slide along a surface of the fixed blade 14 facing the wire exit opening 17*b* and a lower end edge of the wire introduction opening 15*b* of the moving blade 15 to cut the wire 5 having passed through the wire through-hole 17.

Figure 7A:
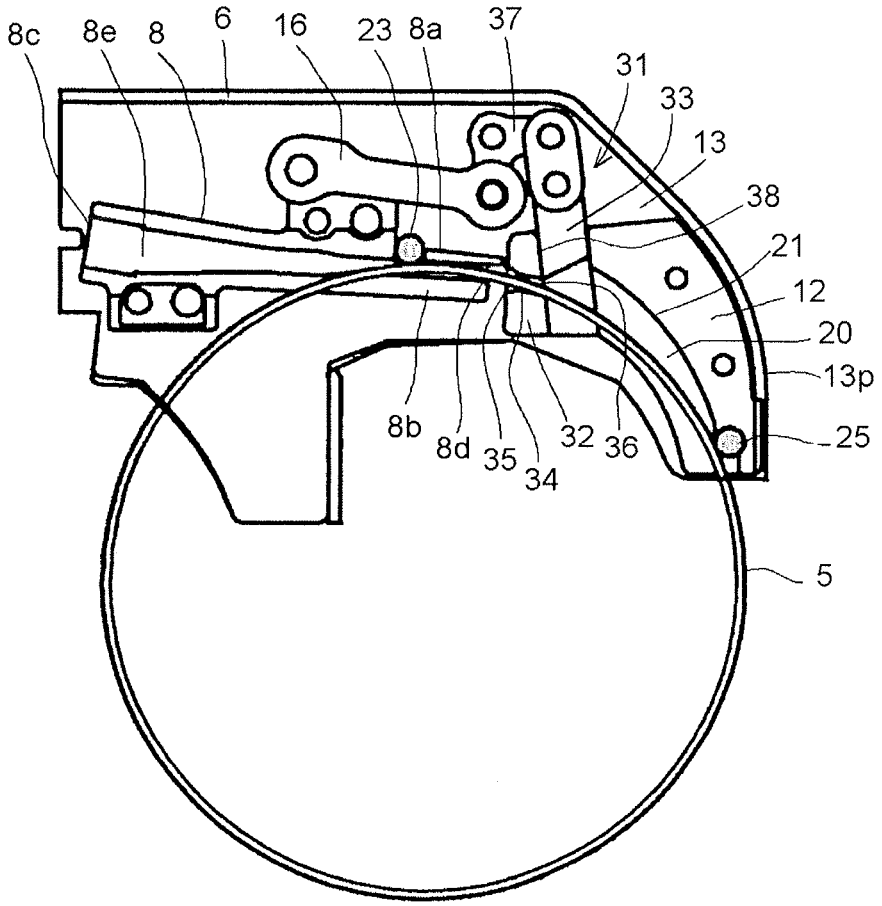
Figure 7B:
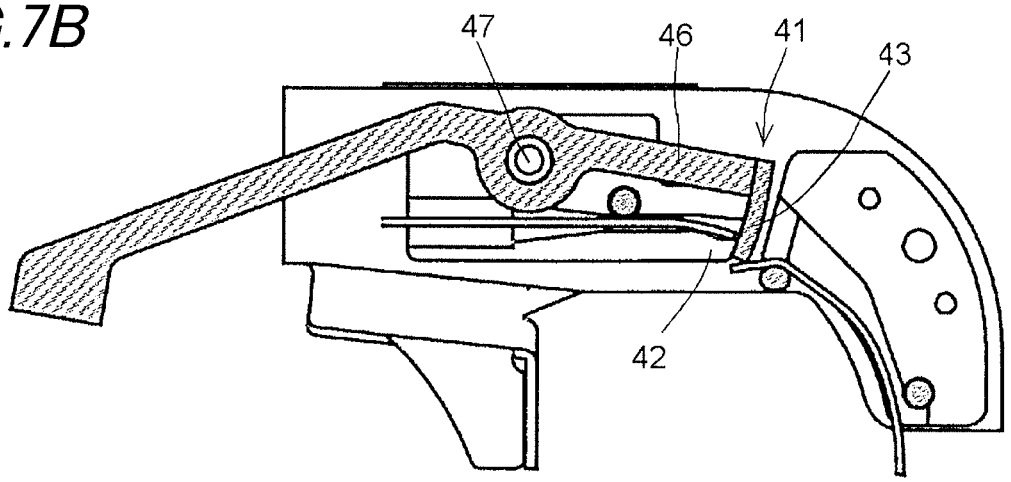

The wire cutting mechanism may use a sliding-type slide cutter shown in FIG. 7A and a swinging-type slide cutter shown in FIG. 7B, in addition to the above rotary cutter. A sliding-type wire cutting mechanism 31 is configured to cut the wire 5 when a feeding amount of the wire 5 reaches a predetermined amount. The wire cutting mechanism 31 has a fixed blade 32 fixed to the guide frame 13, a moving blade 33 configured to slide to the fixed blade 32 and to cut the wire 5, and a driving lever 16 configured to drive the moving blade 33 through a link mechanism 37.

The fixed blade 32 is formed with a wire through-hole 34, which is penetrated towards the feeding direction of the wire 5. One end of the wire through-hole 34 opens towards the tip portion 8*d* of the guiding part (guide member) 8, and the other end thereof opens towards the tip-side of the guide part 6. One end-side opening of the wire through-hole 34 is a wire entry opening 35, and the other end-side opening of the wire through-hole 34 is a wire exit opening 36.

The wire cutting mechanism 31 is configured to move the moving blade 33 downwards (towards an inner side from an outer side of a curve of the wire) through the link mechanism 37 by the driving lever 16, thereby enabling one surface 38 of the moving blade 33 to downwards slide along a surface of the wire through-hole 34 of the fixed blade 32 facing the wire exit opening 36 and a lower end edge of the one surface 38 of the moving blade 33 to cut the wire 5 having passed through the wire through-hole 34. Also, a swinging-type wire cutting mechanism 41 shown in FIG. 7B enables the guide tube 8 to have a function similar to a fixed blade 42, and has the fixed blade 42 (guide tube 8), a moving blade 43 configured to slide to a surface of the fixed blade 42 (guide tube 8) facing the wire exit opening 8*d* and to cut the wire 5, and a swinging arm 46 configured to move the moving blade 43 in a vertical direction. The swinging arm 46 is swingably attached at its substantially central portion to the guide frame 13 by a support shaft 47.

Figure 4:
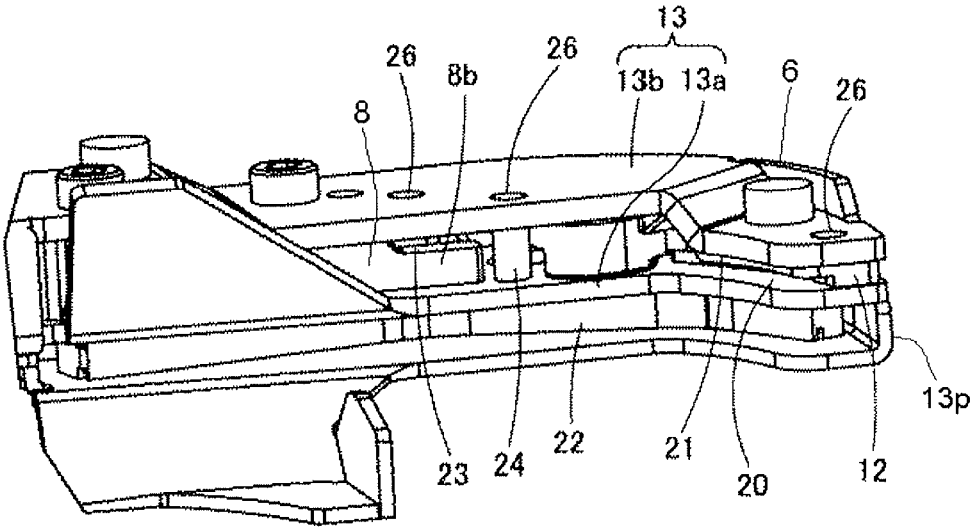
FIG. 4 is a perspective view of a wire guide part, as seen from below.
Figure 5:
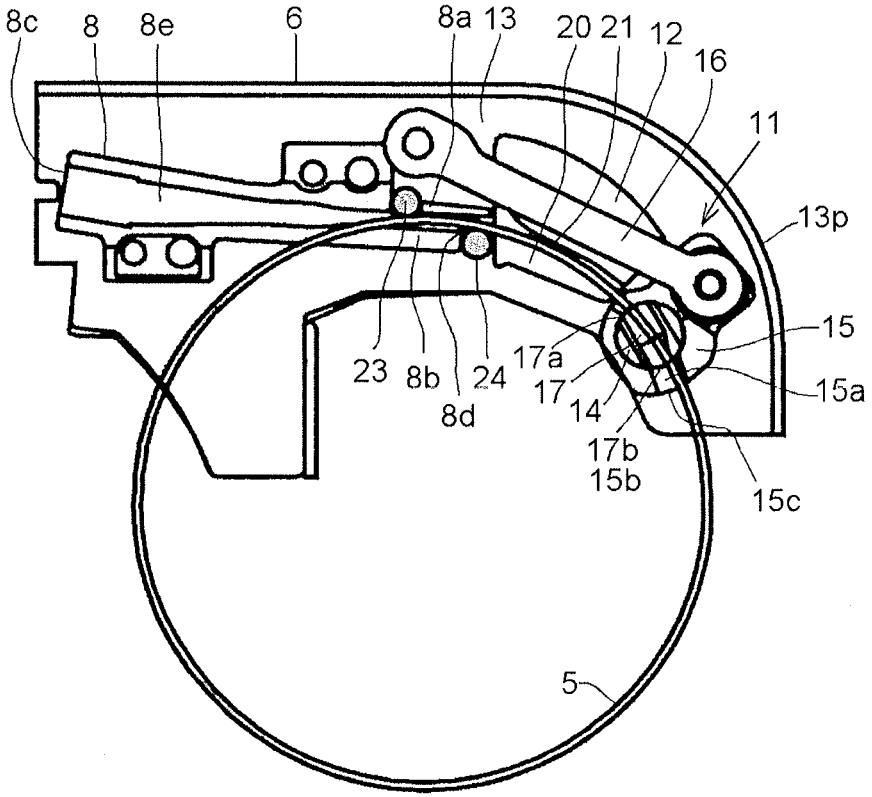
FIG. 5 is a side view illustrating a first illustrative embodiment of a curling mechanism.

The curl guide 12 is fixed to a bent part 13*p* of the guide frame 13, and is formed with a guide recess 20 having a size that one wire 5 can pass therethrough, as shown in FIG. 4. Both frame plates 13*a*, 13*b* of the guide frame 13 configure recess walls of the guide recess. A recess bottom is formed with an arc-shaped guide surface 21 configured to guide the wire 5 having passed through the wire through-hole 17; 34 of the fixed blade 14; 32 in a curling direction.

Also, as shown in FIG. 4, the guide part 6 is formed with a curl pickup guide 22 in the vicinity of the curl guide 12. The curl pickup guide 22 is to pick up an end portion of the wire 5 fed from the curl guide 12 and completely wound in a loop shape and to again guide the same for next winding feeding.

In the above configuration, the wire 5 fed from the guide-side guiding part (guide member) 8 is further fed along the guide surface 21 of the curl guide 12 through the wire through-hole 17; 34 of the fixed blade 14; 32 and is contacted to the guide surface 21 with a predetermined pressure depending on a feeding speed. Therefore, the wire 5 is bent into a curved shape and is thus curled.

Figure 10:
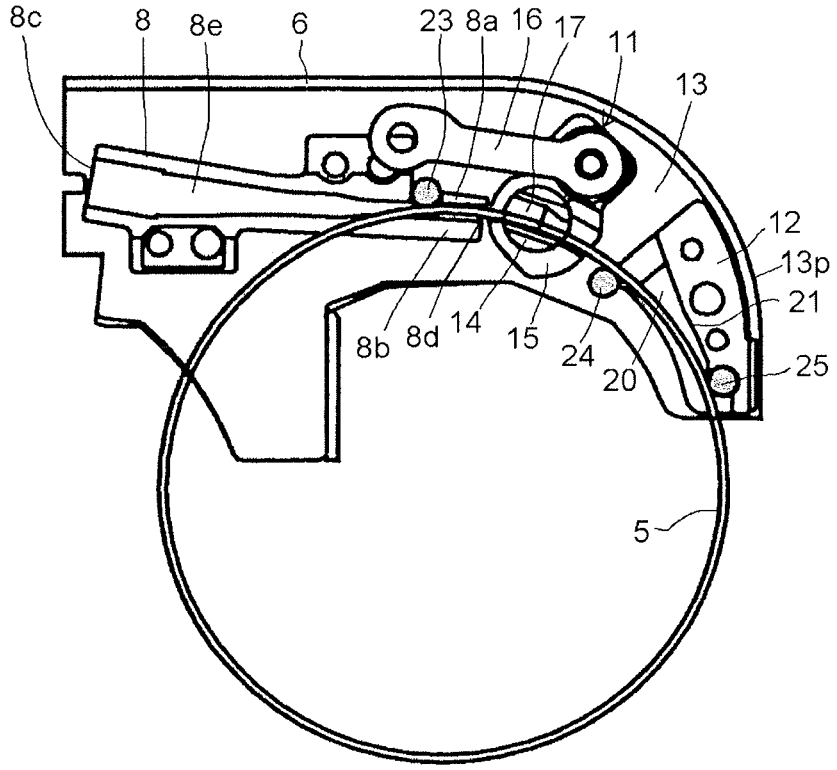
FIG. 10 is a side view illustrating a sixth illustrative embodiment of the curling mechanism.

As shown in FIG. 10, the guide part 6 has the guide-side guiding part (guide member) 8 (hereinafter, referred to as 'guiding part (guide member) 8') configured to guide the feeding of the wire 5 from the wire reel 4, the wire cutting mechanism 11 (or 31) arranged on the feeding path of the wire so as to cut the wire 5 after the predetermined length of the wire 5 is fed, and the curl guide 12 configured to guide the fed wire 5 for curling. Also, the guide part 6 has the curling mechanism having a first guide member 23 configured to guide an outer surface of the wire 5 becoming a bent outer side thereof, a second guide member 24 configured to guide an inner surface of the wire 5 becoming a bent inner side thereof, and a third guide member 25 configured to guide the outer surface of the wire 5 becoming the bent outer side, which are arranged on the feeding path of the wire in corresponding order from the guiding part (guide member) 8-side, i.e., the wire exit opening 8*d* of the end portion of the guiding part (guide member) 8 or the vicinity thereof. The reinforcing bar binding machine 1 is configured to bring the wire 5 into contact with the curling mechanism, i.e., the first guide member 23, the second guide member 24 and the third guide member 25 and to thus curl the wire 5 during the feeding of the wire 5.

Although not shown, the wire twisting device is configured to advance a sleeve, which is pivotally secured to open or close the pair of hooks, by the electric motor to thus close the hooks, to grip the wire 5 wound around the reinforcing bars into a loop shape, to rotate the hooks together with the sleeve to thus twist the wire 5 and to bind the reinforcing bars, and then to open the hooks, to retreat and separate the sleeve from the wire 5 and to return the sleeve to an initial position. The wire twisting device is to operate the driving lever 16 of the wire cutting mechanism 11 (or 31) to cut the wire 5 when the sleeve is advanced.

Also, the wire feeding device, the wire cutting mechanism 11 (or 31) and the wire twisting device are sequence-controlled and operated by a control circuit (not shown). Also, the control circuit is configured to measure the feeding amount of the wire 5 on the basis of a rotating amount of the wire feeding gears 10 of the wire feeding device.

The guide members are further described with reference to FIG. 10. The guide members 23 to 25 are formed of guide pins. Each of the first guide pin 23, the second guide pin 24 and the third guide pin 25 consists of a cylindrical member having a circular section and is fitted and fixed at both end portions to holes 26 formed at both the frame plates 13*a*, 13*b* of the guide frame 13. However, each of the guide pins may be fixed to only one of the frame plates 13*a*, 13*b*.

Also, each of the first to third guide pins 23 to 25 is preferably made of a high hardness material such as carbide pins (cemented carbide pins or ceramic pins) because it is not worn well, and can be manufactured relatively cheaply because a shape thereof is simple. Although the first guide pin 23, the second guide pin 24 and the third guide pin 25 have the circular section, respectively, the sectional shape may be a non-circular section such as an ellipse, a square and a rectangle. That is, the sectional shape is not particularly limited.

Since the first to third guide pins 23 to 25 have a simple shape, respectively, the non-uniformity of the size is simply suppressed. Also, since the size precision is determined just by the attaching positions of the first to third guide pins 23 to 25 to the guide part 6, it is possible to easily secure the precision of the curl diameter. Therefore, the first to third guide pins 23 to 25 to which the wire 5 is to be contacted are provided at the correct positions, so that the curling is correctly provided and the curl diameter is thus stabilized. Also, since the first to third guide pins 23 to 25 have the simple shape, respectively, it is possible to freely select the high hardness material.

As shown in FIG. 10, the first guide pin 23 is provided on an upper part of the end portion of the guiding part (guide member) 8. The second guide pin 24 is provided at a position distant from a lower part of the end portion of the guiding part (guide member) 8. An upper part 8*a* of a tip portion of the guiding part (guide member) 8 is notched, and a lower part 8*b* thereof is elongated. The first guide pin 23 is contacted at its circumferential surface to an end portion surface of the tip upper part 8*a* of the guiding part (guide member) 8. The second guide pin 24 is provided at a position distant from the tip lower part 8*b* of the guiding part (guide member) 8. Thereby, an outer surface of the wire 5 configuring a bent outer side thereof is guided with being contacted to the first guide pin 23. Also, an inner surface of the wire 5 configuring a bent inner side thereof is guided with being contacted to the second guide pin 24. In this way, the wire 5 fed from the guiding part (guide member) 8 is enabled to pass through between the first guide pin 23 and the second guide pin 24.

Also, the third guide pin 25 is arranged inside the tip portion of the curl guide 12. The third guide pin 25 is also attached to protrude more inwardly than the guide surface 21 of the curl guide 12. Therefore, the bent outer surface of the wire 5 fed along the guide surface 21 of the curl guide 12 is guided with being contacted to the third guide pin 25 and is fed downwards. As described above, the third guide pin 25 is attached to the guide frame 13. However, the third guide pin 25 may be attached to the curl guide 12. Also, the third guide pin 25 is arranged with being contacted to the curl guide 12. However, the third guide pin 25 may be provided at an adjacent position with being separated from the curl guide 12. Also, the guide member has been described with reference to the guide pin, for example. However, the tip portion or all of the guiding part (guide member) 8 may be made of a rigid member. Also, the guide surface 21 of the curl guide 12 may be provided with a hard projection formed of a hard member.

In this way, the curling mechanism has the first guide pin 23 to the third guide pin 25, and the wire 5 is contacted to the first guide pin 23, the second guide pin 24 and the third guide pin 25 and is thus curled. The wire 5 is little contacted to the guide path 8*e* of the guiding part (guide member) 8, the wire through-hole 17 of the fixed blade 14 and the guide surface 21 of the curl guide 12, which was contacted with the wire 5 and thus worn in the related art.

As shown in FIG. 10, upon the feeding of the wire 5 from the guiding part (guide member) 8, since the first guide pin 23 and the second guide pin 24 are arranged on the feeding path of the wire in the vicinity of the tip portion of the guiding part (guide member) 8-side, the wire 5 is little contacted to the tip portion of the guiding part (guide member) 8 and is enabled to pass through the wire through-hole 17 of the fixed blade 14 with being guided by the first guide pill 23 and the second guide pin 24. Also, the tip portion vicinity includes a tip portion and a part distant from the tip portion. Also, the end portion-side includes an end portion and a vicinity of the end portion. At this time, since the outer surface and inner surface to be bent of the wire 5 are guided by the first guide pin 23 and the second guide pin 24 with being contacted thereto, the feeding is correctly performed. For this reason, the wire 5 is fed without contacting the inner surface of the wire through-hole 17 of the fixed blade 14. The wire 5 is fed with rubbing against the guide surface 21 of the curl guide 12 and is then sliding-guided to the third guide pin 25, so that it is strongly curled.

In this way, according to the reinforcing bar binding machine 1, the first guide pin 23 and the second guide pin 24 are provided in the vicinity of the tip portion of the guiding part (guide member) 8, the third guide pin 25 is arranged inside the tip portion of the curl guide 12, and the wire 5 is contacted to the first to third guide pills 23 to 25 but is little contacted to the guide path 8*e* of the guiding part (guide member) 8, the wire through-hole 17 of the fixed blade 14 and the guide surface 21 of the curl guide 12. Therefore, the guiding part (guide member) 8, the fixed blade 14 and the curl guide 12 are not worn well.

In the below, a first illustrative embodiment of the wire curling mechanism provided for the guide part 6 is described.

As shown in FIG. 5, the guide part 6 of the reinforcing bar binding machine is configured so that the third guide member serves as a cutting part 14 of the wire cutting mechanism 11 and the cutting part 14 of the wire cutting mechanism 11 cuts the wire 5 fed from the second guide member 24. Since the first and second guide members 23, 24 consist of the guide pins and are attached as described above, the descriptions thereof are omitted.

Also, the cutting part 14 of the wire cutting mechanism 11 functioning as the third guide member is arranged at the tip portion of the guide part 6, and the curl guide 12 is provided between the second guide pin 24 and the cutting part 14 of the wire cutting mechanism 11. Therefore, the outer surface to be bent of the wire 5 fed along the guide surface 21 of the curl guide 12 is guided with being contacted to the cutting part 14 of the wire cutting mechanism 11, is curled and is then fed to the lower guide 19. Thereby, the wire 5 fed from the guiding part (guide member) 8 is guided with the outer surface of the wire 5 configuring a bent outer side thereof being contacted to the first guide pin 23, with the inner surface of the wire 5 configuring a bent inner side thereof being contacted to the second guide pin 24 and with the outer surface of the wire 5 configuring the bent outer side being contacted to the wire through-hole 17 of the fixed blade 14.

Like this, the curling mechanism has the first guide pin 23, the second guide pin 24 and the cutting part 14 of the wire cutting mechanism 11, which are arranged on the feeding path of the wire, and the wire 5 is contacted to the first guide pin 23, the second guide pin 24 and the cutting part 14 of the wire cutting mechanism 11 and is thus curled. The wire 5 is little contacted to the guide path 8*e* of the guiding part (guide member) 8 and the guide surface 21 of the curl guide 12, which was contacted with the wire 5 and thus worn in the related art.

As described above, when the wire 5 is fed from the guiding part (guide member) 8, the wire 5 is little contacted to the tip portion of the guiding part (guide member) 8 and is enabled to pass through the wire through-hole 17 of the fixed blade 14 with being guided by the first guide pin 23 and the second guide pin 24. At this time, since a size between a lower end of the first guide pin 23 and an upper end of the second guide pin 24 is set to be substantially the same as a diameter of the wire 5 and the outer and inner surfaces to be bent of the wire 5 are guided with being contacted by the first guide pin 23 and the second guide pin 24, the feeding is correctly performed. The wire 5 is fed with rubbing against guide surface 21 of the curl guide 12 and is then contacted and guided to the fixed blade 14 of the wire cutting mechanism 11, so that it is strongly curled.

Like this, according to the reinforcing bar bending machine 1, the first guide pin 23 and the second guide pin 24 are provided on the feeding path of the wire in the vicinity of the tip portion of the guiding part (guide member) 8-side, and the cutting part 14 of the wire cutting mechanism 11 is provided on the feeding path of the wire inside the tip portion of the guide part 6, and the wire 5 is contacted to the first guide pin 23, the second guide pin 24 and the cutting part 14 of the wire cutting mechanism 11 but is little contacted to the guide path 8*e* of the guiding part (guide member) 8 and the guide surface 21 of the curl guide 12. Therefore, the guiding part (guide member) 8 and the curl guide 12 are not worn and the durability is considerably improved. According to the reinforcing bar bending machine of the related art, since the guide path 8*e* of the guiding part (guide member) 8 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1. Since the wire cutting mechanism 11 is arranged next to the second guide pin 24, the debris of the cut wire 5 is easily discharged from the guide part 6 and the blocking of the wire 5 is not thus caused.

Subsequently, a second illustrative embodiment of the wire curling mechanism provided for the guide part 6 is described.

Figure 6:
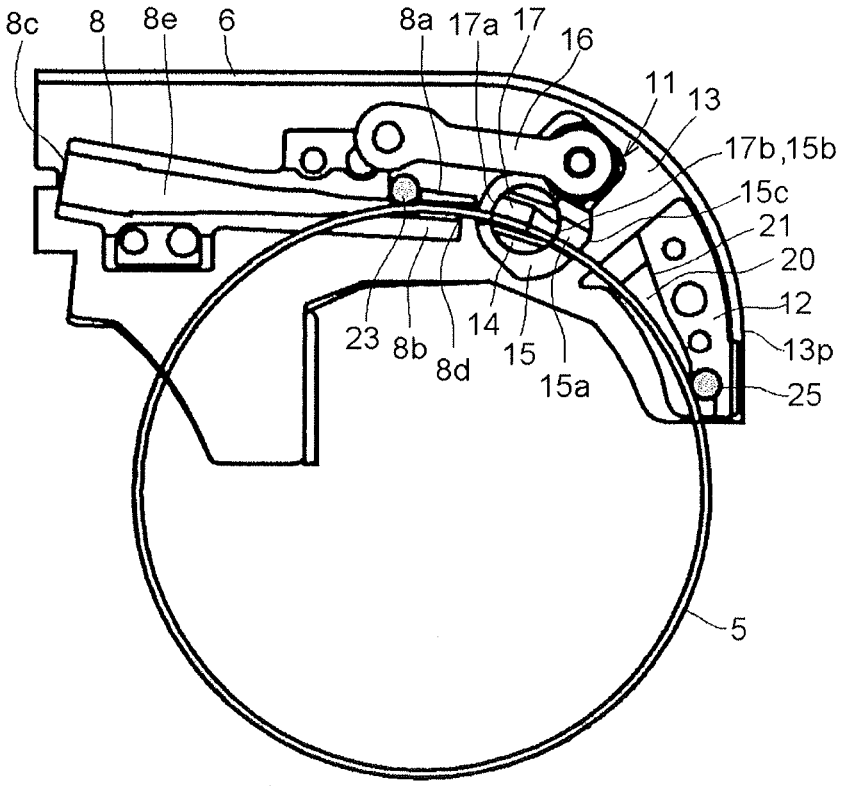
FIG. 6 is a side view illustrating a second illustrative embodiment of the curling mechanism.

As shown in FIG. 6, the guide part 6 of the reinforcing bar bending machine 1 is configured so that the second guide member serves as the cutting part 14 of the wire cutting mechanism 11, the third guide member 25 is arranged at the curl guide 12 and the cutting part 14 of the wire cutting mechanism 11 cuts the wire 5 fed from the first guide member 23. Since the first and third guide members 23, 25 consist of the guide pins and are attached as described above, the descriptions thereof are omitted.

The first guide pin 23 is provided on the upper part of the end portion of the guiding part (guide member) 8. The upper part 8*a* of the tip portion of the guiding part (guide member) 8 is notched and the lower part 8*b* is elongated. The first guide pin 23 is contacted at its circumferential surface to the end portion surface of the tip upper part 8*a* of the guiding part (guide member) 8 and protrudes towards the inside of the guiding part (guide member) 8. The third guide pin 25 is arranged inside the tip portion of the curl guide 12, and is attached to protrude more inwardly than the guide surface 21 of the curl guide 12. Therefore, the wire 5 is fed along the guide surface 21 of the curl guide 12, and the outer surface to be bent of the wire 5 is guided with being contacted to the third guide pin 25, is curled and is then fed to the lower guide 19.

The cutting part 14 of the wire cutting mechanism 11 arranged between the first guide pin 23 and the third guide pin 25 functions as the second guide member. The cutting part 14 of the wire cutting mechanism 11 is arranged at the wire exit opening 8*e* of the end portion of the guiding part (guide member) 8. Thereby, the wire 5 fed from the guiding part (guide member) 8 is guided with an outer surface of the wire 5 configuring a bent outer side thereof being contacted to the first guide pin 23, with an inner surface of the wire 5 configuring a bent inner side thereof being contacted to the wire through-hole 17 of the fixed blade 14 and with the outer surface of the wire 5 configuring the bent outer side being contacted to the third guide pin 25.

Like this, the curling mechanism has the first guide pin 23, the cutting part 14 of the wire cutting mechanism 11 and the third guide pin 25, which are arranged on the feeding path of the wire, and the wire 5 is contacted to the first guide pin 23, the cutting part 14 of the wire cutting mechanism 11 and the third guide pin 25 and is thus curled. The wire 5 is little contacted to the guide path 8*e* of the guiding part (guide member) 8 and the guide surface 21 of the curl guide 12, which was contacted with the wire 5 and thus worn in the related art.

As described above, when the wire 5 is fed from the guiding part (guide member) 8, the wire 5 is little contacted to the tip portion of the guiding part (guide member) 8 and is enabled to pass through the wire through-hole 17 of the fixed blade 14 with being guided by the first guide pin 23. At this time, since the outer and inner surfaces to be bent of the wire 5 are guided with being contacted by the lower end of the first guide pin 23 and the wire through-hole 17 of the cutting part 14, the feeding is correctly performed. The wire 5 is fed with rubbing against guide surface 21 of the curl guide 12 and is then contacted and guided to the first guide pill 23, so that it is strongly curled.

Like this, according to the reinforcing bar bending machine 1, the first guide pin 23 and the fixed blade 14 of the wire cutting mechanism 11 are provided on the feeding path of the wire in the vicinity of the tip portion of the guiding part (guide member) 8, the third guide pin 25 is arranged on the feeding path of the wire inside the tip portion of the curl guide 12, and the wire 5 is contacted to the first guide pin 23, the fixed blade 14 of the wire cutting mechanism 11 and the third guide pin 25 but is little contacted to the guide path 8*e* of the guiding part (guide member) 8 and the guide surface 21 of the curl guide 12. Therefore, the guiding part (guide member) 8 and the curl guide 12 are not worn and the durability is considerably improved. According to the reinforcing bar bending machine of the related art, since the guide path 8*e* of the guiding part (guide member) 8 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1.

Also, since the wire cutting mechanism 11 is arranged next to the first guide pin 23, a length of the wire 5 at its initial position, which protrudes from the guiding part (guide member) 8, is relatively straight to the wire cutting mechanism 11 and is short, as shown in FIG. 6. Therefore, for example, when pulling out the wire 5 from the wire path of the guide part 6 so as to separate the wire reel 4 for maintenance, a distance in which the disturbance may be caused is short and the pulling out operation can be easily performed.

Subsequently, a third illustrative embodiment of the wire curling mechanism provided for the guide part 6 is described.

As shown in FIG. 7, the guide part 6 of the reinforcing bar bending machine 1 is configured so that the second guide member serves as the cutting part 32 of the wire cutting mechanism 31, the third guide member 25 is arranged at the curl guide 12 and the cutting part 34 of the wire cutting mechanism 31 cuts the wire 5 fed from the first guide member 23. Since the first and third guide members 23, 25 consist of the guide pins and are attached as described above, the descriptions thereof are omitted.

The cutting part 32 of the wire cutting mechanism 31 arranged between the first guide pin 23 and the third guide pin 25 functions as the second guide member. The cutting part 32 of the wire cutting mechanism 31 is arranged at the wire exit opening 8*e* of the end portion of the guiding part (guide member) 8. Thereby, the wire 5 fed from the guiding part (guide member) 8 is guided with an outer surface of the wire 5 configuring a bent outer side thereof being contacted to the first guide pin 23, with an inner surface of the wire 5 configuring a bent inner side thereof being contacted to the wire through-hole 34 of the fixed blade 32 and with an outer surface of the wire 5 configuring a bent outer side thereof being contacted to the third guide pin 25.

Like this, the curling mechanism has the first guide pin 23, the cutting part 32 of the wire cutting mechanism 31 and the third guide pin 25, which are arranged on the feeding path of the wire, and the wire 5 is contacted to the first guide pin 23, the cutting part 32 of the wire cutting mechanism 31 and the third guide pin 25 and is thus curled. The wire 5 is little contacted to the guide path 8*e* of the guiding part (guide member) 8 and the guide surface 21 of the curl guide 12, which was contacted with the wire 5 and thus worn in the related art.

As described above, when the wire 5 is fed from the guiding part (guide member) 8, the wire 5 is little contacted to the tip portion of the guiding part (guide member) 8 and is enabled to pass through the wire through-hole 34 of the fixed blade 32 with being guided by the first guide pin 23. At this time, since the outer and inner surfaces to be bent of the wire 5 are guided with being contacted by the lower end of the first guide pin 23 and the wire through-hole 34 of the fixed blade 32, the feeding is correctly performed. The wire 5 is fed with rubbing against guide surface 21 of the curl guide 12 and is then contacted and guided to the third guide pin 25, so that it is strongly curled.

Like this, according to the reinforcing bar bending machine 1, the first guide pin 23 and the fixed blade 32 of the wire cutting mechanism 31 are provided on the feeding path of the wire in the vicinity of the tip portion of the guiding part (guide member) 8, the third guide pin 25 is arranged on the feeding path of the wire inside the tip portion of the curl guide 12, and the wire 5 is contacted to the first guide pin 23, the fixed blade 32 of the wire cutting mechanism 31 and the third guide pin 25 but is little contacted to the guide path 8*e* of the guiding part (guide member) 8 and the guide surface 21 of the curl guide 12. Therefore, the guiding part (guide member) 8 and the curl guide 12 are not worn and the durability is considerably improved. Also, the tip portion vicinity includes a tip portion and a part distance from the tip portion. Also, the end portion-side includes an end portion and a vicinity of the end portion. According to the reinforcing bar bending machine of the related art, since the guide path 8*e* of the guiding part (guide member) 8 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1.

Also, since the wire cutting mechanism 31 is arranged next to the first guide pin 23, the length of the wire 5 at its initial position, which protrudes from the guiding part (guide member) 8, is relatively straight to the wire cutting mechanism 11 and is short, as shown in FIG. 7. Therefore, for example, when pulling out the wire 5 from the wire path of the guide part 6 so as to separate the wire reel 4 for maintenance, a distance in which the disturbance may be caused is short and the pulling out operation can be easily performed.

Subsequently, a fourth illustrative embodiment of the wire curling mechanism provided for the guide part 6 is described.

Figure 8:
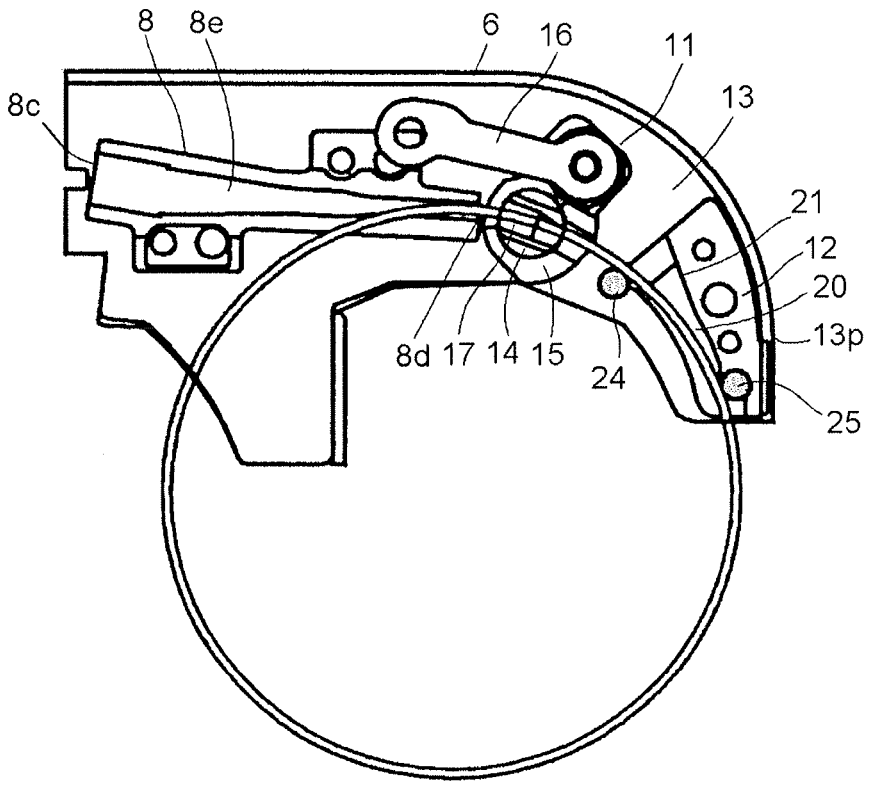
FIG. 8 is a side view illustrating a fourth illustrative embodiment of the curling mechanism.

As shown in FIG. 8, the guide part 6 of the reinforcing bar bending machine 1 is configured so that the first guide member serves as the cutting part 14 of the wire cutting mechanism 11, the third guide member 25 is arranged at the curl guide 12 and the cutting part 14 of the wire cutting mechanism 11 cuts the wire 5 fed from the wire exit opening of the end portion of the guiding part (guide member) 8. Since the second and third guide members 24, 25 consist of the guide pins and are attached as described above, the descriptions thereof are omitted. The cutting part 14 of the wire cutting mechanism 11 is provided at a substantial center between the guiding part (guide member) 8 and the second guide pin 24.

The cutting part 14 of the wire cutting mechanism 11 functions as the first guide member. Thereby, the wire 5 fed from the guiding part (guide member) 8 is guided with an outer surface of the wire 5 configuring a bent outer side of the wire 5 thereof being contacted to the cutting part 14 of the wire cutting mechanism 11, with an inner surface of the wire 5 configuring a bent inner side thereof being contacted to the second guide pin 24 and with an outer surface of the wire 5 configuring a bent outer side thereof being contacted to the third guide pin 25, is curled and is then fed to the lower guide 19. The wire 5 fed from the guiding part (guide member) 8 is inserted into the wire through-hole 17 of the fixed blade 14 of the wire cutting mechanism 11 before it is contacted to the second guide pin 24, and is then fed to the second guide pin 24. Also, the tip portion of the wire 5 is guided to the cutting part 14 of the wire cutting mechanism 11 and the second guide pin 24, is fed with sliding along the guide surface 21 of the curl guide 12, is contacted to the third guide pin 25 and is then strongly curled.

Like this, the curling mechanism has the cutting part 14 of the wire cutting mechanism 11, the second guide pin 24 and the third guide pin 25, which are arranged on the feeding path of the wire, and the wire 5 is contacted to the cutting part 14 of the wire cutting mechanism 11, the second guide pin 24 and the third guide pin 25 and is thus curled. The wire 5 is little contacted to the guide path 8*e* of the guiding part (guide member) 8 and the guide surface 21 of the curl guide 12, which was contacted with the wire 5 and thus worn in the related art.

As described above, when the wire 5 is fed from the guiding part (guide member) 8, the wire 5 is little contacted to the tip portion of the guiding part (guide member) 8 and is guided by the wire through-hole 17 of the fixed blade 14, the second guide pin 24 and the third guide pin 25. Since the outer and inner surfaces to be bent of the wire 5 are guided with being contacted by the wire through-hole 17 of the fixed blade 14, the second guide pin 24 and the third guide pin 25, the feeding is correctly performed. The wire 5 is fed with rubbing against guide surface 21 of the curl guide 12 and is then contacted and guided to the third guide pin 25, so that it is strongly curled.

Like this, according to the reinforcing bar bending machine 1, the wire 5 is sequentially contacted to the wire through-hole 17 of the fixed blade 14, the second guide pin 24 and the third guide pin 25, and is little contacted to the tip portion of the guiding part (guide member) 8 and the guide surface 21. Therefore, the guiding part (guide member) 8 and the curl guide 12 are not worn and the durability is considerably improved. According to the reinforcing bar bending machine of the related art, since the guide path 8*e* of the guiding part (guide member) 8, the wire through-hole 17 of the fixed blade 14 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1.

Also, since the wire cutting mechanism 11 is arranged next to the guiding part (guide member) 8, the length of the wire 5 at its initial position, which protrudes from the guiding part (guide member) 8, is short to the wire cutting mechanism 11, as shown in FIG. 8. Therefore, for example, when pulling out the wire 5 from the wire path of the guide part 6 so as to separate the wire reel 4 for maintenance, a distance in which the disturbance may be caused is short, and there is no disturbing member except for the wire cutting mechanism 11, so that the pulling out operation can be easily performed. Also, in the first to fourth illustrative embodiments, since the wire cutting mechanism also serves as the guide member, a space for arranging one guide member in the guide part 6 is not required, so that the guide part 6 can be made to be compact. Also, the cutting part configured to guide the wire has been described with reference to the fixed blades 14, 32. However, the cutting part may be the moving blades 15, 33. That is, the cutting part is not particularly limited.

Subsequently, a fifth illustrative embodiment of the wire curling mechanism provided for the guide part 6 is described.

Figure 9:
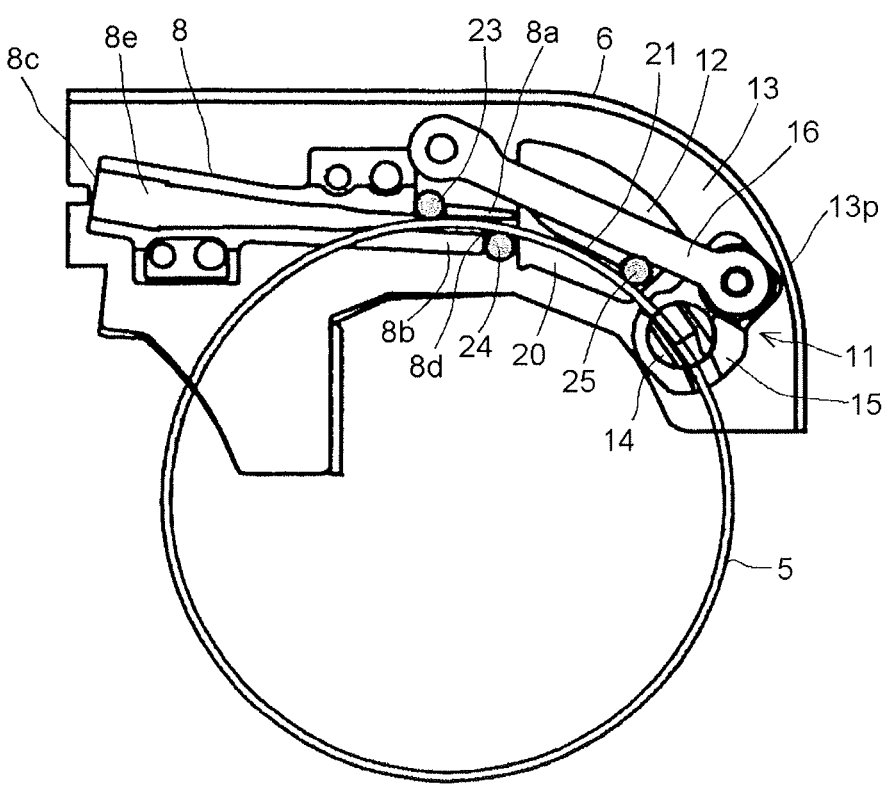
FIG. 9 is a side view illustrating a fifth illustrative embodiment of the curling mechanism.

As shown in FIG. 9, the reinforcing bar bending machine 1 is configured so that the third guide member 25 is arranged at the curl guide 12, the cutting part 14 of the wire cutting mechanism 11 is arranged next to the third guide pin 25 and the cutting part 14 of the wire cutting mechanism 11 cuts the wire 5 fed from the first guide member 23. Since the guide members 23 to 25 consist of the guide pins and are attached as described above, the descriptions thereof are omitted.

The first guide pin 23 is provided on the upper part of the end portion vicinity of the guiding part (guide member) 8. The second guide pin 24 is provided on the lower part of the end portion vicinity of the guiding part (guide member) 8. The upper part 8*a* of the tip portion of the guiding part (guide member) 8 is notched and the lower part 8*b* is elongated. The first guide pin 23 is contacted at its circumferential surface to the end portion surface of the tip upper part 8*a* of the guiding part (guide member) 8. The first guide pin 23 and the second guide pin 24 protrude towards the inside of the guiding part (guide member) 8, respectively. A size between a lower end of the circumferential surface of the first guide pin 23 and an upper end of the circumferential surface of the second guide pin 24 is set to be substantially the same as the diameter of the wire 5. Thereby, an outer surface of the wire 5 configuring a bent outer side thereof is guided with being contacted to the first guide pin 23. Also, an inner surface of the wire 5 configuring a bent inner side thereof is guided with being contacted to the second guide pin 24. In this way, the wire 5 fed from the guiding part (guide member) 8 is enabled to pass through between the first guide pin 23 and the second guide pin 24.

The curl guide 12 at which the third guide pin 25 is arranged is attached continuously to the tip-side of the guiding part (guide member) 8. As described above, the third guide pin 25 is arranged inside the tip portion of the curl guide 12, and is attached to protrude more inwardly than the guide surface 21 of the curl guide 12. The wire 5 fed from the guiding part (guide member) 8 is guided with an outer surface of the wire 5 configuring a bent outer side thereof being contacted to the first guide pin 23, with an inner surface of the wire 5 configuring a bent inner side thereof being contacted to the second guide pin 24 and with an outer surface of the wire 5 configuring a bent outer side thereof being contacted to the third guide pin 25, is curled and is then enabled to pass through the wire through-hole 17 of the fixed blade 14 of the wire cutting mechanism 11, so that it is fed to the lower guide 19. Also, the tip portion of the wire 5 is guided to the first guide pin 23 and the second guide pin 24, is fed with sliding along the guide surface 21 of the curl guide 12, and is contacted to the third guide pin 25, so that it is strongly curled.

Like this, the curling mechanism has the first guide pin 23 to the third guide pin 25, which are arranged on the feeding path of the wire, and the wire 5 is contacted to the first guide pin 23, the second guide pin 24 and the third guide pin 25 and is thus curled. The wire 5 is little contacted to the guide path 8*e* of the guiding part (guide member) 8, the wire through-hole 17 of the fixed blade 14 and the guide surface 21 of the curl guide 12, which was contacted with the wire 5 and thus worn in the related art.

As described above, when the wire 5 is fed from the guiding part (guide member) 8, the wire 5 is guided by the first guide pin 23, the second guide pin 24 and the third guide pin 25, and is also enabled to pass through the wire through-hole 17 of the fixed blade 14 of the wire cutting mechanism 11 arranged on the feeding path of the wire. The wire 5 is guided with the outer surface, inner surface and outer surface to be bent of the wire 5 being contacted by the first guide pin 23, the second guide pin 24 and the third guide pin 25, so that the feeding is correctly performed.

Like this, according to the reinforcing bar bending machine 1, the first guide pin 23 and the second guide pin 24 are provided at the tip portion of the guiding part (guide member) 8, the third guide pin 25 is arranged inside the tip portion of the curl guide 12 and the wire 5 is contacted to the first to third guide pins 23 to 25 but is little contacted to the guide path 8*e* of the guiding part (guide member) 8, the wire through-hole 17 of the fixed blade 14 and the guide surface 21 of the curl guide 12. Therefore, the guiding part (guide member) 8, the fixed blade 14 and the curl guide 12 are not worn and the durability is considerably improved. According to the reinforcing bar bending machine of the related art, since the guide path 8*e* of the guiding part (guide member) 8, the wire through-hole 17 of the fixed blade 14 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1. Also, since the wire cutting mechanism 11 is arranged next to the third guide pin 25, the debris of the cut wire 5 is easily discharged from the guide part 6 and the blocking of the wire 5 is not thus caused.

Subsequently, a sixth illustrative embodiment of the wire curling mechanism provided for the guide part 6 is described.

As shown in FIG. 10, the guide part 6 of the reinforcing bar bending machine 1 is configured so that the third guide member 25 is arranged at the curl guide 12, the cutting part 14 of the wire cutting mechanism 11 is arranged between the first guide member 23 and the second guide member 24 and the cutting part 14 of the wire cutting mechanism 11 cuts the wire 5 fed from the first guide member 23. Since the first to third guide members 23 to 25 consist of the guide pins and are attached as described above, the descriptions thereof are omitted.

The first guide pin 23 is provided on the upper part of the end portion vicinity of the guiding part (guide member) 8. The end portion vicinity includes an end portion and a part distant from the end portion. Also, the end portion-side includes an end portion and a vicinity of the end portion. The third guide pin 25 is arranged inside the tip portion of the curl guide 12, and is attached to protrude more inwardly than the guide surface 21 of the curl guide 12. The second guide pin 24 is arranged at a substantial center between the first guide pin 23 and the third guide pin 25. The cutting part 14 of the wire cutting mechanism 11 is provided at a substantial center between the first guide pin 23 and the second guide pin 24.

The upper part 8*a* of the tip portion of the guiding part (guide member) 8 is notched and the lower part 8*b* is elongated. The first guide pin 23 is contacted at its circumferential surface to the end portion surface of the tip upper part 8*a* of the guiding part (guide member) 8 and protrudes towards the inside of the guiding part (guide member) 8. Therefore, the wire 5 fed from the guiding part (guide member) 8 is guided with an outer surface of the wire 5 configuring a bent outer side thereof being contacted to the first guide pin 23, with an inner surface of the wire 5 configuring a bent inner side thereof being contacted to the second guide pin 24 and with an outer surface of the wire 5 configuring a bent outer side thereof being contacted to the third guide pin 25, is curled and is then fed to the lower guide 19. After the wire 5 is guided to the first guide pin 23, the wire is inserted into the wire through-hole 17 of the fixed blade 14 of the wire cutting mechanism 11 before it is contacted to the second guide pin 24, and is then fed to the second guide pin 24. Also, the tip portion of the wire 5 is guided to the first guide pin 23 and the second guide pin 24, is fed with sliding along the guide surface 21 of the curl guide 12, is contacted to the third guide pin 25 and is then strongly curled.

Like this, the curling mechanism has the first guide pin 23 to the third guide pin 25, which are arranged on the feeding path of the wire, and the wire 5 is contacted to the first guide pin 23, the second guide pin 24 and the third guide pin 25 and is thus curled. The wire 5 is little contacted to the guide path 8*e* of the guiding part (guide member) 8, the wire through-hole 17 of the fixed blade 14 and the guide surface 21 of the curl guide 12, which was contacted with the wire 5 and thus worn in the related art.

As described above, when the wire 5 is fed from the guiding part (guide member) 8, since the first guide pin 23 is arranged at the tip portion of the guiding part (guide member) 8, the wire 5 is little contacted to the tip portion of the guiding part (guide member) 8, is guided to the first guide pin 23 and is enabled to pass through the wire through-hole 17 of the fixed blade 14. Also, since the outer and inner surfaces to be bent of the wire 5 are guided with being contacted by the first guide pin 23 and the second guide pin 24, the feeding is correctly performed. Since the fixed blade 14 of the wire cutting mechanism 11 arranged on the feeding path of the wire is provided between the first guide pin 23 and the second guide pin 24, the wire 5 is fed without contacting the inner surface of the wire through-hole 17 of the fixed blade 14. Then, the wire 5 is fed with rubbing against guide surface 21 of the curl guide 12 and is then contacted and guided to the third guide pin 25, so that it is strongly curled.

Like this, according to the reinforcing bar bending machine 1, the wire 5 is contacted to the first to third guide pins 23 to 25 but is little contacted to the guide path 8*e* of the guiding part (guide member) 8, the wire through-hole 17 of the fixed blade 14 and the guide surface 21 of the curl guide 12. Therefore, the guiding part (guide member) 8, the fixed blade 14 and the curl guide 12 are not worn and the durability is considerably improved. According to the reinforcing bar bending machine of the related art, since the guide path 8*e* of the guiding part (guide member) 8, the wire through-hole 17 of the fixed blade 14 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1.

Also, since the wire cutting mechanism 11 is arranged next to the first guide pin 23, the length of the wire 5 at its initial position, which protrudes from the guiding part (guide member) 8, is relatively straight to the wire cutting mechanism 11 and is short, as shown in FIG. 10. Therefore, for example, when pulling out the wire 5 from the wire path of the guide part 6 so as to separate the wire reel 4 for maintenance, a distance in which the disturbance may be caused is short, and the pulling out operation can be easily performed. Also, when feeding the wire 5 from the guiding part (guide member) 8 to the wire path of the guide part 6 upon the insertion of the wire 5, the wire path is relatively straight until the tip portion of the wire 5 is contacted to the guide surface 21 of the curl guide 12, as shown in FIG. 10. Therefore, since the wire through-hole 17 of the wire cutting mechanism 11 is arranged on the straight wire path, the wire 5 can be easily fed upon the insertion of the wire 5.

Subsequently, a seventh illustrative embodiment of the wire curling mechanism provided for the guide part 6 is described.

Figure 11:
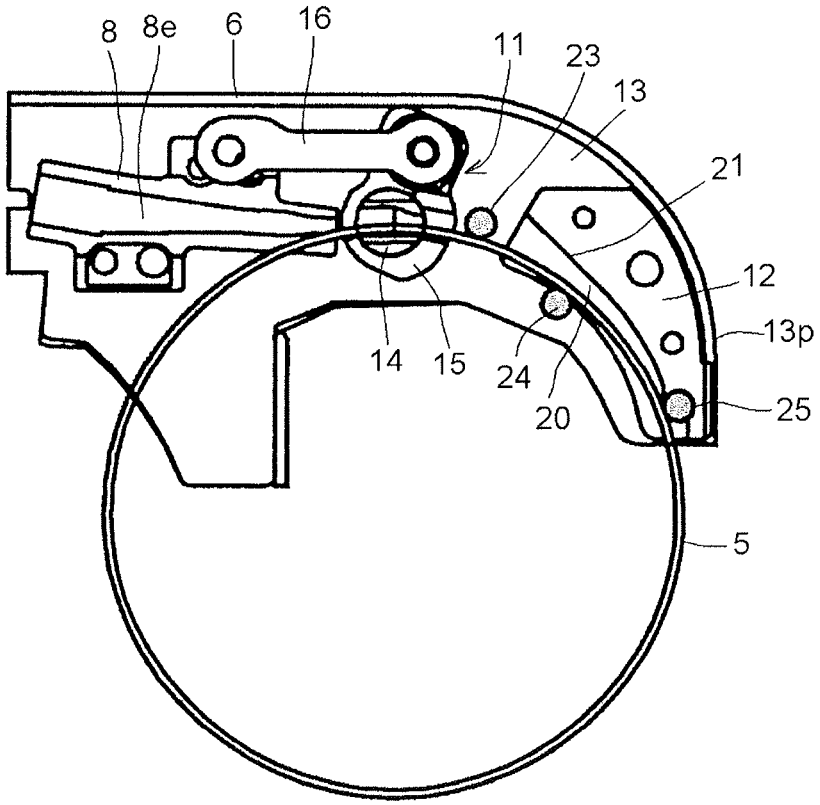
FIG. 11 is a side view illustrating a seventh illustrative embodiment of the curling mechanism.

As shown in FIG. 11, the reinforcing bar bending machine 1 is configured so that the third guide member 25 is arranged at the curl guide 12, the cutting part 14 of the wire cutting mechanism 11 is arranged between the guiding part (guide member) 8 and the first guide member 23 and the cutting part 14 of the wire cutting mechanism 11 cuts the wire 5 fed from the wire exit opening of the end portion of the guiding part (guide member) 8. Since the guide members 23 to 25 consist of the guide pins and are attached as described above, the descriptions thereof are omitted.

The first guide pin 23 is provided with being spaced from the end portion, of the guiding part (guide member) 8. The third guide pin 25 is arranged inside the tip portion of the curl guide 12 and is attached to protrude more inwardly than the guide surface 21 of the curl guide 12. The second guide pin 24 is arranged at a substantial center between the first guide pin 23 and the third guide pin 25. The cutting part 14 of the wire cutting mechanism 11 is provided at a substantial center between the guiding part (guide member) 8 and the first guide pin 23.

The wire 5 fed from the guiding part (guide member) 8 is guided with an outer surface of the wire 5 configuring a bent outer side thereof being contacted to the first guide pin 23, with an inner surface of the wire 5 configuring a bent inner side thereof being contacted to the second guide pin 24 and with an outer surface of the wire 5 configuring a bent outer side thereof being contacted to the third guide pin 25, is curled and is then fed to the lower guide 19. The wire 5 fed from the guiding part (guide member) 8 is inserted into the wire through-hole 17 of the fixed blade 14 of the wire cutting mechanism 11 before it is contacted to the first guide pin 23, and is then fed to the first guide pin 23. Also, the tip portion of the wire 5 is guided to the first guide pin 23 and the second guide pin 24, is fed with sliding along the guide surface 21 of the curl guide 12, is contacted to the third guide pin 25 and is then strongly curled.

Like this, the curling mechanism has the first guide pin 23 to the third guide pin 25, which are arranged on the feeding path of the wire, and the wire 5 is contacted to the first guide pin 23, the second guide pin 24 and the third guide pin 25 and is thus curled. The wire 5 is little contacted to the guide path 8*e* of the guiding part (guide member) 8, the wire through-hole 17 of the fixed blade 14 and the guide surface 21 of the curl guide 12, which was contacted with the wire 5 and thus worn in the related art.

As described above, when the wire 5 is fed from the guiding part (guide member) 8, the wire 5 is little contacted to the tip portion of the guiding part (guide member) 8, and is enabled to pass through the wire through-hole 17 of the fixed blade 14 of the wire cutting mechanism 11 arranged on the feeding path of the wire, is guided by the first guide pin 23, the second guide pin 24 and the third guide pin 25. Since the wire 5 is guided with the outer surface, inner surface and outer surface to be bent of the wire 5 being contacted by the first guide pin 23, the second guide pin 24 and the third guide pin 25, the feeding is correctly performed. For this reason, the wire 5 is fed without contacting the inner surface of the wire through-hole 17 of the fixed blade 14. Then, the wire 5 is fed with rubbing against guide surface 21 of the curl guide 12 and is strongly curled.

Like this, according to the reinforcing bar bending machine 1, the wire 5 is contacted to the first to third guide pins 23 to 25 but is little contacted to the guide path 8*e* of the guiding part (guide member) 8, the wire through-hole 17 of the fixed blade 14 and the guide surface 21 of the curl guide 12. Therefore, the guiding part (guide member) 8, the fixed blade 14 and the curl guide 12 are not worn and the durability is considerably improved. According to the reinforcing bar bending machine of the related art, since the guide path 8*e* of the guiding part (guide member) 8, the wire through-hole 17 of the fixed blade 14 and the guide surface 21 of the curl guide 12 are likely to be worn because the wire 5 is repeatedly contacted to the same, when the corresponding parts are worn and are thus reduced, the curl diameter is influenced. However, the corresponding problems do not occur well in the reinforcing bar bending machine 1.

Also, since the wire cutting mechanism 11 is arranged next to the guiding part (guide member) 8, the length of the wire 5 at its initial position, which protrudes from the guiding part (guide member) 8, is short to the wire cutting mechanism 11, as shown in FIG. 11. Therefore, for example, when pulling out the wire 5 from the wire path of the guide part 6 so as to separate the wire reel 4 for maintenance, a distance in which the disturbance may be caused is short, and there is no disturbing member except for the wire cutting mechanism 11, so that the pulling out operation can be easily performed. Also, in the seventh and ninth illustrative embodiments, since the wire cutting mechanism 11 is independently arranged outside the areas of the first to third guide pins 23 to 25 of the curling mechanism on the wire feeding path of the guide part 6, it does not directly influence the curling of the wire 5 by the curling mechanism, so that the wire 5 can be easily curled.

The present invention can be applied to the reinforcing bar bending machine.

What is claimed is:

1. A reinforcing bar binding machine, comprising:

a guiding part that is configured to guide feeding of a wire from a wire reel;

a curl guide which guides and curls the wire fed from the guiding part, wherein the curl guide includes a first guide member, a second guide member, and a third guide member which contact surfaces of the wire to guide and curl the wire, with the surfaces of the wire including an inner surface which forms a radially inner portion of a curl and an outer surface which forms a radially outer portion of the curl;

the first guide member is positioned to contact the outer surface to curl the wire with the outer surface forming the radially outer portion of the curl;

the second guide member is positioned to contact the inner surface to curl the wire with the inner surface forming the radially inner portion of the curl; and the third guide member is positioned to contact the outer surface to curl the wire with the outer surface forming the radially outer portion of the curl, wherein the first guide member is located downstream from the guiding part in a wire feeding direction, the second guide member is located downstream from the first guide member, and the third guide member is located downstream from the second guide member, and wherein any one of the first guide member, the second guide member and the third guide member comprises a cutting part which cuts the wire after a predetermined length of the wire is fed from the guiding part.

2. The reinforcing bar binding machine according to claim 1, wherein the third guide member comprises the cutting part.

3. The reinforcing bar binding machine according to claim 1, wherein the second guide member comprises the cutting part.

4. The reinforcing bar binding machine according to claim 1, wherein the first guide member comprises the cutting part.

5. The reinforcing bar binding machine according to claim 1, wherein at least one of the first guide member, the second guide member and the third guide member is a guide pin.

6. A reinforcing bar binding machine, comprising:

a guiding part that is configured to guide feeding of a wire from a wire reel;

a cutting part that is configured to cut the wire after a predetermined length of the wire is fed from the guiding part;

a curl guide which guides and curls the wire fed from the guiding part, wherein the curl guide includes a first guide member, a second guide member and a third guide member which guide and curl the wire by guiding surfaces of the wire, with the surfaces of the wire including an inner surface which forms a radially inner portion of a curl and an outer surface which forms a radially outer portion of the curl;

a wire feeding passage path that includes the guiding part, the cutting part and the curl guide;

the first guide member is positioned to guide the outer surface to curl the wire with the outer surface forming the radially outer portion of the curl;

the second guide member is positioned to guide the inner surface to curl the wire with the inner surface forming the radially inner portion of the curl; and the third guide member is positioned to guide the outer surface with the outer surface forming the radially outer portion of the curl, wherein the first guide member is downstream from the guiding part, the second guide member is downstream from the first guide member, and the third guide member is downstream from the second guide member on the wire feeding passage path, and wherein the cutting part is positioned along the wire feeding passage path at a location other than a region between the first guide member and the third guide member.

7. The reinforcing bar binding machine according to claim 6, wherein the cutting part is provided at a location downstream from the third guide member on the wire feeding passage path.

8. The reinforcing bar binding machine according to claim 6, wherein the cutting part is provided between the guiding part and the first guide member on the wire feeding passage path.

9. The reinforcing bar binding machine according to claim 6, wherein at least one of the first guide member, the second guide member and the third guide member is a guide pin.

* * * * *